US005941044A

United States Patent [19]

Sera

[11] Patent Number: 5,941,044

[45] Date of Patent: Aug. 24, 1999

[54] CONNECTION STRUCTURE BETWEEN A COLUMN AND CROSS BEAMS OF TIMBER CONSTRUCTION AND A CONNECTION METHOD FOR CONNECTING THE COLUMN AND CROSS BEAMS

[76] Inventor: Yousuke Sera, 268, Sanba-cho, Onomichi-shi, Hiroshima-ken, Japan

[21] Appl. No.: 09/044,827

[22] Filed: Mar. 20, 1998

[30] Foreign Application Priority Data

Aug. 6, 1997 [JP] Japan ..... 9-225708

[51] Int. Cl.[6] ..... E04B 1/00

[52] U.S. Cl. ..... 52/655.1; 52/656.9; 52/651.07; 52/272; 403/347; 403/407.1

[58] Field of Search ..... 52/272, 282.3, 52/656.9, 651.07, 702, 704, 736.2; 403/234, 237, 347, 407.1

[56] References Cited

U.S. PATENT DOCUMENTS

| | | | |
|---|---|---|---|
| 2,097,172 | 10/1937 | Yurkivitch | 403/347 X |
| 3,748,814 | 7/1973 | Cribben | 403/347 X |
| 3,966,337 | 6/1976 | Crawford | 403/170 |
| 4,360,287 | 11/1982 | Larsson et al. | 403/347 X |
| 5,242,239 | 9/1993 | Hosokawa | 403/407.1 X |
| 5,253,945 | 10/1993 | Hosokawa | 403/407.1 X |
| 5,438,811 | 8/1995 | Goya | 52/702 |
| 5,555,694 | 9/1996 | Commins | 403/237 X |
| 5,577,856 | 11/1996 | Tezuka | 52/656.9 X |
| 5,625,987 | 5/1997 | Zamerovsky | 403/347 X |

FOREIGN PATENT DOCUMENTS

| | | | |
|---|---|---|---|
| 3-206225 | 9/1991 | Japan | 52/272 |
| 4-269232 | 9/1992 | Japan | 52/272 |
| 8-312007 | 11/1996 | Japan . | |

*Primary Examiner*—Carl D. Friedman
*Assistant Examiner*—Brian E. Glessner
*Attorney, Agent, or Firm*—Smith Patent Office

[57] ABSTRACT

A connection structure for connecting a column and cross beam includes a column, a first cross beam extending in a horizontal direction, a second cross beam extending in a horizontal direction, a first through hole formed in the column, a second through hole formed in the column having a common space with the first through hole, a first attachment bolt inserted into the first through hole, a second attachment bolt inserted into the second through hole, a connecting member having a connecting portion to connect with the first connecting portion of the first attachment bolt and a third supporting portion to support the first cross beam connected with the column, and an additional connecting member having a further connecting portion to connect with the second connecting portion of the second attachment bolt and a fourth supporting portion to support the second cross beam connected with the column.

16 Claims, 10 Drawing Sheets

Fig. 4
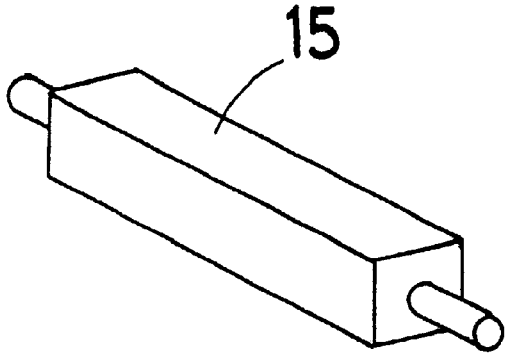
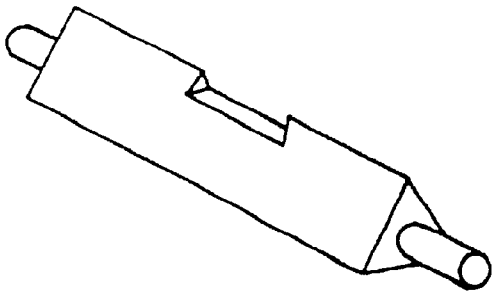
Fig. 5A
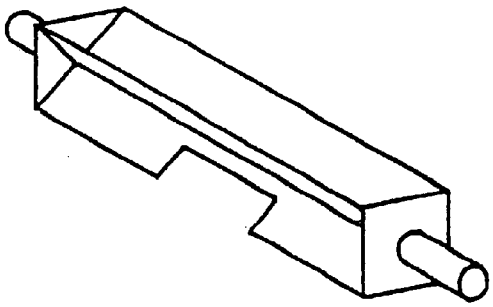
Fig. 5B

CONNECTION STRUCTURE BETWEEN A COLUMN AND CROSS BEAMS OF TIMBER CONSTRUCTION AND A CONNECTION METHOD FOR CONNECTING THE COLUMN AND CROSS BEAMS

BACKGROUND OF THE INVENTION

1. Field of the Invention

The present invention relates to a wooden connection structure and method of connecting a column and cross beams in a timber construction.

2. Discussion of the Related Art

In general, connecting a column and beam, especially a horizontal timber cross beam, is carried out by a mortise and tenon joint. In case of this joint, the processing of the mortise and tenon joint is carried out by carpenter at a building location, or it is carried out in advance by using a specified machine at a work shop.

In the above mentioned cases, since it requires carpenters having some special skill in the former operation and a specified processing machine in the latter operation, it is difficult to provide an inexpensive timber construction.

Currently known is a connecting structure using a U-shaped metal fitting to connect a column with a cross beam which is disclosed in, for example, Japanese Laid Open Patent Publication No. 8-312007.

In the conventional connecting structure, a U-shaped metal fitting is fixed to the column by bolts through a mortise groove disposed at the side wall of the column. Then the opposite side piece of the metal fitting against the fixed portion to the column is inserted and fixed to a tenon (a slit portion) formed at the side wall of the cross beam.

When a load is transmitted from the cross beam to the column, the column receives a force corresponding to a fiber direction of the column and a parallel direction to the column. The cross beam also receives a force corresponding to a fiber direction of the cross beam and at right-angles to the cross beam.

Assuming that the cross beam has enough strength against a force in the fiber direction in the above prior art, it is described that the metal fitting has a supporting plate welded to the lower edge of the main body of the metal fitting to receive the load of the cross beam.

In other words, the prior art is considered with an external force affecting the cross beam, but it does not consider a load affecting the column at all.

As the result of research by the applicant, it was determined that a force parallel to the fiber direction of the column, causes a relative deformation between the column and the cross beam. Further, it was also learned that the parallel force causes the same effect on the timber construction, when the timber construction receives a large external force. To make sure that the new constructions are earthquake proof, the above problem and external force can not be ignored.

Solutions have been considered to solve these problems. These solutions include selecting a column material from a special material that would be strong against a force in the fiber direction. Secondly, a bolt having a large diameter could be used and thirdly, the number of bolts could be increased.

However, if a special material is used, it is difficult to process the material and it is also expensive. In the second case, using a large diameter bolt should be used with a column having a relatively large cross section considering the increased loss in the cross sectional area of the column and it is also expensive. In the third case, since the space between the bolts becomes relatively thin, the thickness of the fiber disposed in between the bolts is reduced and it is easy for the fiber to collapse.

In other words, since the cross sectional loss of the column caused by the opening for the bolts has a large percentage of the entire cross sectional area of the column, the strength of the column is reduced.

The purpose of the present invention is to provide a solution that does not require complicated processing of the column and cross beam and is without the above mentioned problems. It is also desired to provide a timber construction that is able to receive a relatively large load and is inexpensive to produce.

SUMMARY OF THE INVENTION

It is an object of the present invention to provide a connection structure between a column and cross beams of a timber construction and a connecting method of between a column and cross beams of a timber. Each of structures does not need to have complicated processing and they can receive a relatively large load. It is inexpensive to provide this connection and it can precisely and completely transfer a load from the cross beam to the column.

The above objects of the present invention are achieved by providing a connection structure for connecting a column and cross beam comprising a column extending in a substantially vertical direction; a first cross beam extending in a substantially horizontal direction for connecting with a first vertical surface of the column; a second cross beam extending in a substantially horizontal direction for connecting with a second vertical surface of the column disposed at right angles to the first vertical surface; a first through hole formed in the column from the first vertical surface; a second through hole formed in the column from the second vertical surface and having a common space with the first through hole in the column; a first attachment bolt inserted into the first through hole of the column; the first attachment bolt having a first main body portion to be disposed in the column and a first connecting portion extending in the substantially horizontal direction from the first main body portion to the outside of the column through the first through hole; a second attachment bolt inserted into the second through hole of the column; the second attachment bolt having a second main body portion to be disposed in the column, and a second connecting portion extending in the substantially horizontal direction from the second main body portion to the outside of the column through the second through hole, and an upper surface in surface contact with a lower surface of the first attachment bolt, when the first and second attachment bolts are inserted into the first and second through holes respectively and positioned in predetermined positions in the common space; a connecting member having a third connecting portion to connect with the first connecting portion of the first attachment bolt and a third supporting portion to support the first cross beam connected with the column; and an additional connecting member having a fourth connecting portion to connect with the second connecting portion of the second attachment bolt and a fourth supporting portion to support the second cross beam connected with the column.

Further, the above objects of the present invention are achieved by providing a connection method for connecting a column and first and second cross beams, the column extending in a substantially vertical direction, the first cross beam extending in a substantially horizontal direction to connect with a first vertical surface of the column, and the second cross beam extending in the substantially horizontal direction to connect with a second vertical surface of the column disposed at right angles to the first vertical surface. The method comprising the steps of forming a first through hole extending from the first vertical surface to the interior of the column, forming a second through hole extending from the second vertical surface to the interior of the column and having a common space with the first through hole in the column, inserting a first attachment bolt into the first through hole and positioning the first attachment bolt at a predetermined position in the column, the first attachment bolt comprising a first main body portion having flat portions on upper and lower surfaces of the first main body portion respectively, a first recess portion formed in at least one of the upper and lower surfaces and a first connecting portion extending in the substantial horizontal direction from the first main body portion, inserting a second attachment bolt into the second through hole, the second attachment bolt comprising a second main body portion having flat portions at upper and lower surfaces of the second main portion respectively, a second recess portion formed in at least of the upper and lower surfaces which is the same surface to the first recess portion of the first attachment bolt and a second connecting portion extending in the substantially horizontal direction from the second main body portion, positioning and engaging the second main body portion of the attachment bolt with the recess portion of the first attachment bolt at a predetermined position in the common space, and connecting the first and second connecting portions of the first and second attachment bolts to third and fourth connecting portions of third and fourth connecting members respectively and supporting the first and second cross beams with third and fourth supporting portions of the third and fourth connecting members respectively.

It is another object of the present invention to provide a connection structure between a column and cross beams of a timber construction and a connecting method between a column and cross beams of a timber construction, each of which has an enough strength against a torsional moment around an axis of the column.

It is the other object of the present invention to provide a connection structure between a column and cross beams of a timber construction and a connecting method between a column and cross beams of a timber construction, which has a compact assembly attachment bolt unit to decrease a loss of cross section of the column.

BRIEF DESCRIPTION OF THE DRAWINGS

The above and others objects and features of the present invention will be clearly understood from the following description with respect to the preferred embodiments thereof when considered in conjunction with the accompanying drawings, in which:

FIG. 4 is a perspective view of an attachment bolt in accordance with another embodiment of the present invention;

FIGS. 5A and 5B are perspective views of additional attachment bolts in accordance with further embodiments of the present invention;

DETAILED DESCRIPTION OF THE PREFERRED EMBODIMENTS

The present invention will now be described in detail with reference to preferred embodiments and the drawings.

Figure 1:
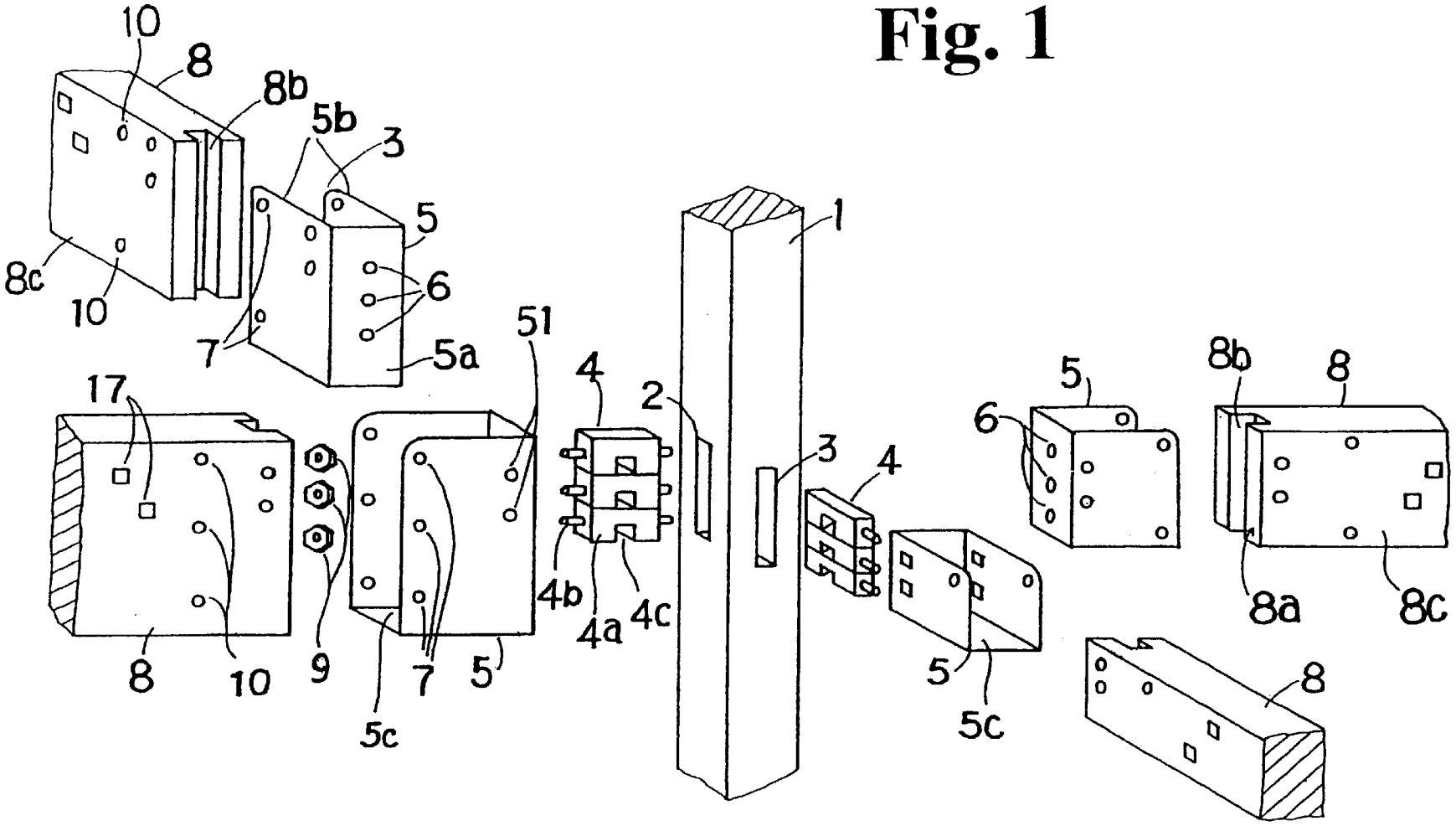
FIG. 1 is an exploded perspective view showing the assembly of metal fittings, attachment bolts to a column and cross beams in accordance with a first embodiment of the present invention.

FIG. 1 is an exploded perspective view showing metal fittings 5, attachment bolts 4, a column for balloon framing and a set of cross beams 8. The column 1 has through holes 2 and 3 into which the attachment bolts 4 can be inserted. Each of the through holes 2 and 3 extends from each side surface of the column 1 so that they are disposed in an orthogonal direction to each other and extend all of the way through the column. Further, each of the through holes 2 and 3 has a common space in the column 1. The attachment bolts 4 are inserted into the through holes 2 and 3, and they have a main body portion 4*a* comprising rectangular parallelopiped bolt portions 4*b* disposed at the both ends of the main body portion 4*a* and a recess portion 4*c* formed in the middle and lower portion of the main body portion 4*a*. The bolts 4 have a predetermined width and depth to engage the other bolt 4 inserted from the other through hole. In detail, a bottom surface 4*h* of the recess portion 4*c* is parallel to the lower surface 4*g* of the main body portion 4*a* and the width 4*i* of the recess portion 4*c* is a substantially the same as the width 4*f* of the main body portion 4*a* so as to engage in surface contact with the other bolt 4 inserted from the other through hole.

As the result of the size of the above recess portion, both side surfaces of the recess portion 4*c* are in contact with the side surfaces of the main body portion of the other bolt 4 inserted from the other side as the bolts 4 are assembled.

The metal fitting 5 for attaching the bolt portion 4*b* of the attachment bolt 4 is U-shaped, and has a center piece 5*a* formed with bolt insert holes 6 for inserting the bolts 4 into. The metal fitting 5 includes side pieces 5*b* disposed on the right and left sides of the center piece 5*a* and extending parallel to an axis of the metal fitting 5. The metal fitting 5 includes a bottom piece 5*c* having a plate shape and it is connected to each lower edge portion of the center and side pieces 5*a* and 5*b*. The plurality of bolt insert holes 6 in the center piece 5*a* are spaced apart a predetermined amount from each other and they are formed a line.

The pitch between one bolt insert hole 6 and the next bolt insert hole 6 is set based on a pitch between the bolt portion 4*b* of the bolt 4 and the next bolt portion 4*b* of the bolt 4 disposed adjacent to the above bolt portion 4*b*. This pitch is measured when the bolts 4 are inserted into the through holes 2 and 3 of the column 1 and assembled in the space of the through holes 2 and 3.

After the cross beam 8 is positioned in the metal fitting 5, each bolt (not shown) is inserted into the bolt insert hole 7 formed in each of the side pieces 5*b*.

A side edge surface 8*a* of the cross beam 8 mounted and fixed to the metal fitting 5 has a slot 8*b* to prevent interference between the side edge surface 8*a* and an attachment nut 9 to fix the metal fitting 5 to the column 1 by cooperation with the attachment bolt 4. The slot 8*b* extends from the upper surface to the lower surface of the cross beams. The slot 8*b* is in a line and the width and depth of the slot 8*b* are selected based on the thickness of the nut 9 and the number of the nuts 9.

A side surface 8*c* of the cross beam 8 has a plurality of through holes 10 which are disposed in a portion corresponding to the bolt insert hole 7 of the metal fitting 5 to fix the metal fitting 5 to the cross beam 8. The length, width and height of the metal fitting 5 are set based on the cross sectional size of the cross beam connected to the column 1. Each bolt 4 is inserted into the through holes 2 and 3 and then it is positioned.

A detailed description of the bolt assembly will be described hereinafter. Each bolt 4 is inserted and positioned in the through holes 2 and 3. They are inserted into each of the bolt insert holes 6 disposed in the center piece 5*a* of the metal fitting 5 and then the nut 9 is attached to the end. This operation is carried out along all surfaces of the column 1. After this operation is complete, each cross beam 8 is mounted on the bottom piece 5*c* of the metal fitting 5 and then is positioned against the bottom piece 5*c*. Each bolt (not shown) for fixing the metal fitting 5 to the cross beam 8, is inserted into the bolt insert hole 7 and the through hole 10 of the cross beam 8 and then it is attached from both sides of the cross beam 8.

Figure 2A:
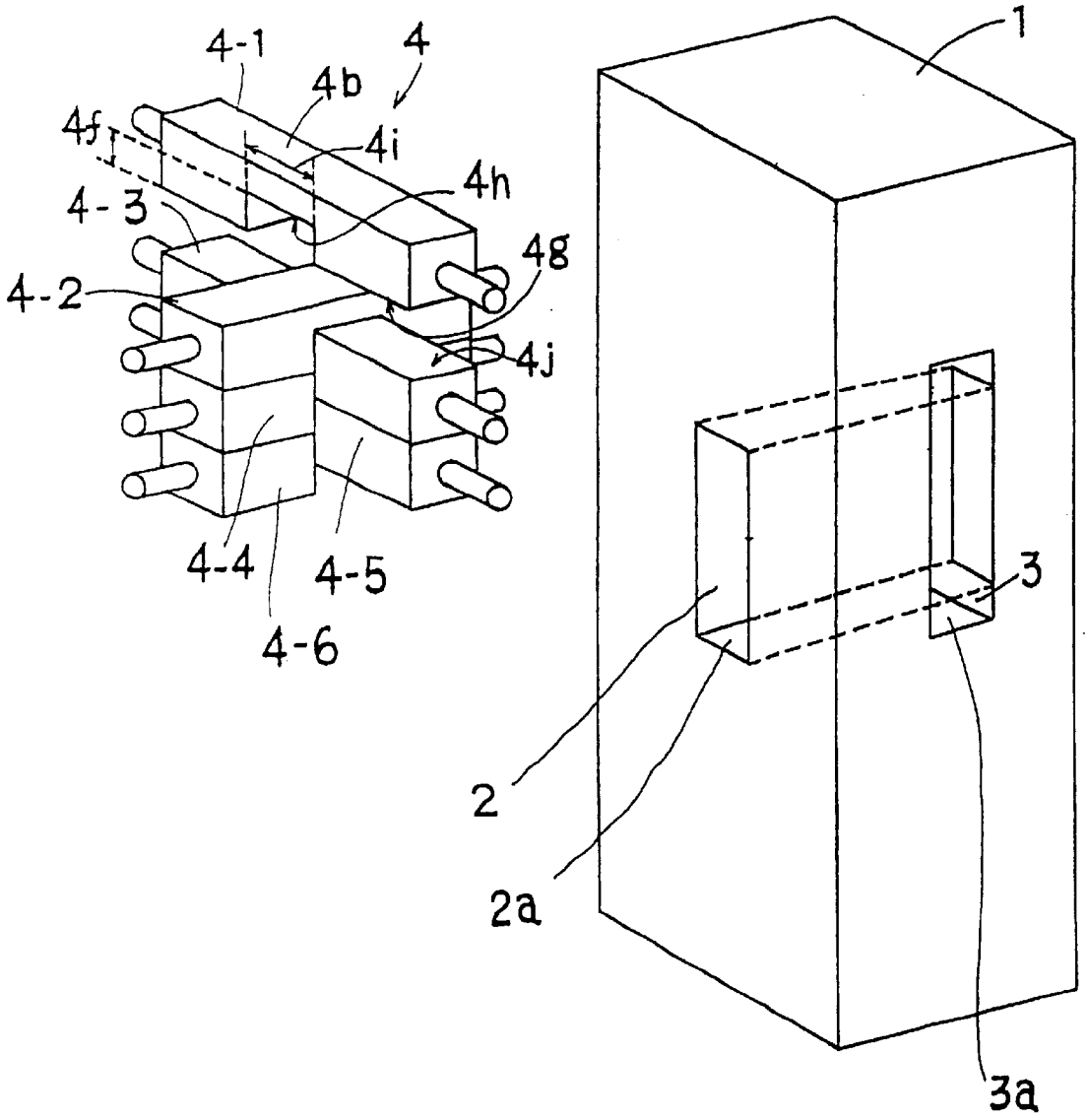
FIGS. 2A, 2B and 2C are perspective views showing the assembly of bolts in accordance with the first embodiment of the present invention.

FIG. 2A shows a detailed assembly operation for the bolts 4. According to the present embodiment, there are three attachment bolts corresponding to each insert direction for a total of six bolts (each bolt is numbered 4-1 through 4-6 respectively).

How to assemble the bolt 4-1 and the bolt 4-2 at right angles to each other as well as how to assemble all of the bolts 4 will now be described.

It is preferred that the depth of the recess portion 4*c* of the bolt 4-1 be half of the thickness of the bolt 4-1 based on considering the compactness and strength of the bolt assembling unit 4-1 through 4-6, when each bolt 4 has the same thickness and width.

Further, it is preferred that the width 4*i* of the recess portion 4*c* is substantially the same as the width 4*f* of the bolt 4.

When the assembling unit 4-1 through 4-6 is assembled based on the above mentioned depth and width for the recess portion 4*c*, the unit 4-1 through 4-6 can be formed with substantially no space between the adjacent surfaces of the bolts 4.

Accordingly, a shearing force affecting each bolt 4 transfers along each bolt 4 to the bolts 4-5 and 4-6 which are disposed at lowest position among them.

As the result, the through holes 2 and 3 transfer the shearing force from each bolt 4 to the column 1 by way of bolts 4-5 and 4-6. The through hole 2 is rectangularly shaped and has substantially the same width as the width of the main body portion 4*a* of the bolt 4 so as to receive the bolt 4. The bottom surface 2*a* of the through hole 2 is in surface contact with the lower surface of the main body portion 4*a* of the bolt 4-6, when the bolt 4-6 is inserted and positioned in the hole 2.

The hole 3 is formed at right angles to the hole 2 and is rectangularly shaped and has substantially the same width as the width of the main body portion 4*a* of the bolt 4 to receive the bolt 4.

The bottom surface 3*a* of the hole 3 is in surface contact with the lower surface of the main body portion 4*a* of the bolt 4-5, when the bolt 4-5 is inserted and positioned in the hole 3. Along the longitudinal direction of the column 1, the bottom surface 2*a* of the hole 2 is offset from the bottom surface 3*a* of the hole 3.

In the present embodiment, the offset amount is set at substantially half of the height of the main body portion 4*a* of the bolt 4. However, it is also preferred that the amount is larger than half of the height of the main body portion of the bolt 4 when considering the sizes of the hole and bolt as well as their tolerances. Further, a standard amount for the offset between the bottom surfaces of the holes 2 and 3, is that amount of offset that is equal to or larger than an amount which subtracts the size of the depth of the recess portion 4*c* of the bolt 4 from the size of the main body portion 4*a* of the bolt 4.

Accordingly, since each of the attachment bolts 4 has a relatively large area in contact with each other and the inside of the column 1, the input load from each of the cross beams 8 transfers precisely to the column.

It is preferred that the length of the main body portion 4*a* of the bolt 4 is substantially the same as the length of the holes 2 and 3 which is the same as the width of the column 1 so as to keep a maximum contact area between the holes 2 and 3 and the bolts 4. The above mentioned assembling structure comprising the bolts 4 and the holes 2 and 3 of the column 1 has the maximum contact area between them and restricts unnecessary movement of the metal fitting 5 that might cause a collapse of the column 1.

Since the recess portion 4*c* of the bolt 4 is formed to increase the contact area between the bolts 4, the unit comprising the bolts 4-1 through 4-6 can transfer precisely the load from the cross beam 8 to the column 1 and the height of the assembling unit can be lower than the height of a unit having no recessed portions.

Further, such a lower height can provide compactness to the unit and the metal fitting and reduce the cross sectional loss of strength and resistance of the column 1 caused by the space of the holes 2 and 3.

Furthermore, since the recess portion 4*c* is formed at the lower surface of the bolt 4, each edge portion of the recess portion 4*c* moves toward the inside of the recess portion 4*c* when the column 1 receives a load from the cross beam 8. In other words, in the above situation, since each edge portion of the recess portion 4*c* is deformed toward the inside of the recess portion it catches the main body portion 4*a* of the other bolt 4 which is disposed below it and since it contacts this structure there is no problem about breakage of the bolts.

Figure 2B:
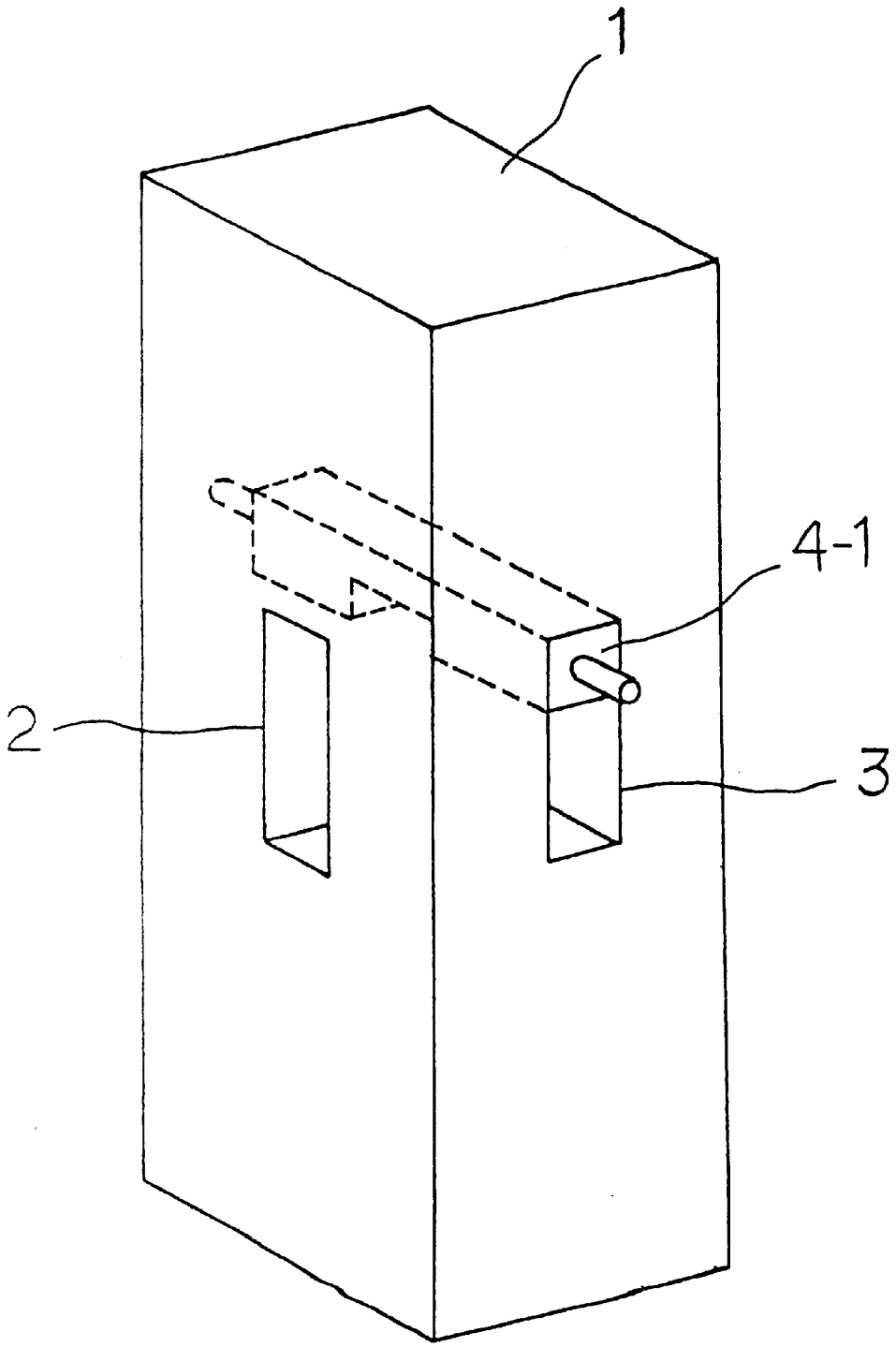
Figure 2C:
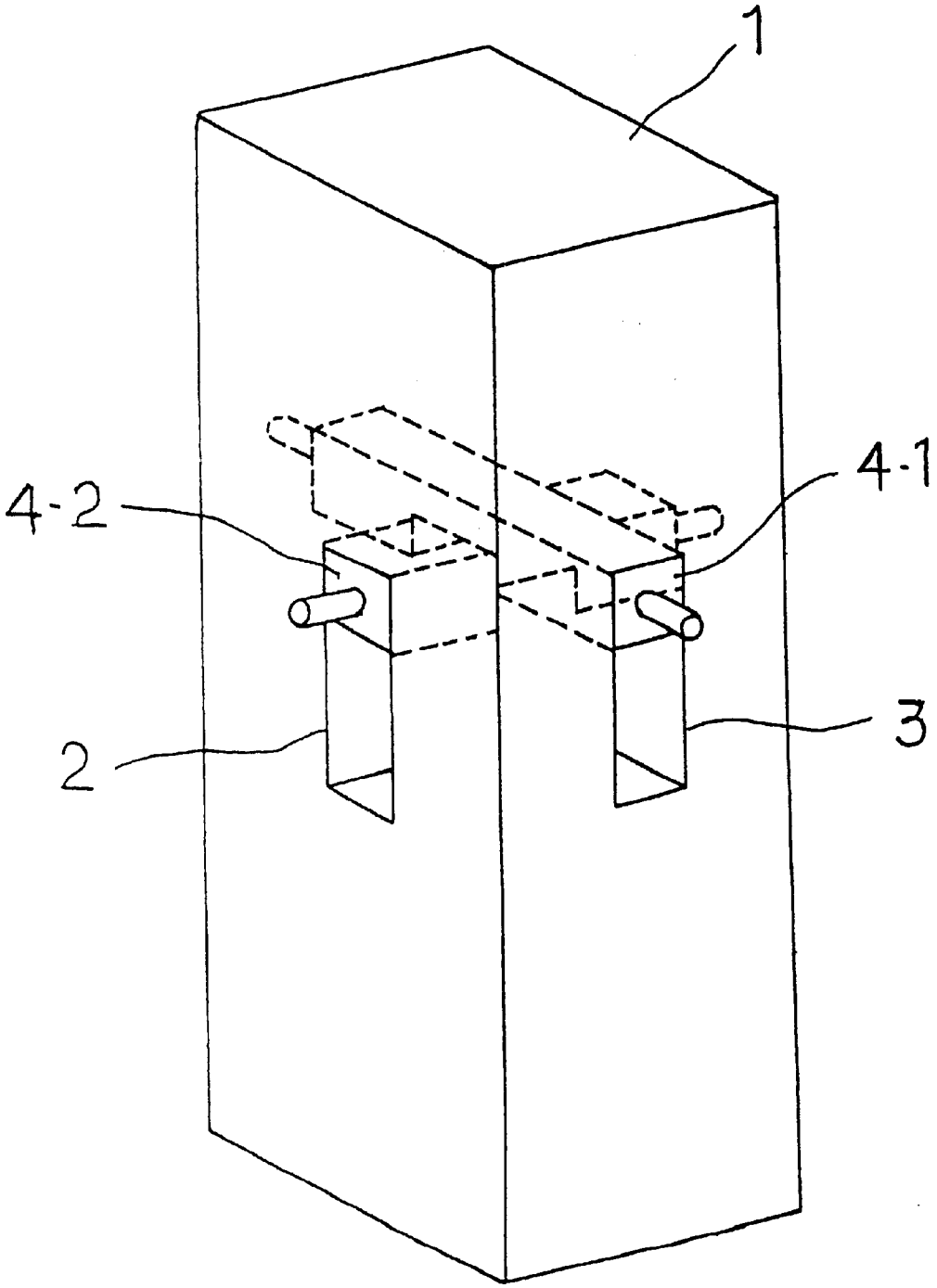

It will be described hereinafter how to assemble the bolts 4 to each other based on FIGS. 2B and 2C.

The height of the through hole 3 disposed in the column 1 is higher than the height of the hole 2 by about a half or more than the thickness of the main body portion 4*a* of the bolt 4 to allow insertion of the bolt 4-1 which is disposed at the highest position of the bolt assembling unit. First, the bolt 4-1 is inserted into the hole 3 and positioned so as to contact the upper surface of the bolt 4-1 to the upper inner surface of the hole 3. Then, the bolt 4-2 is inserted into the hole 2 and the main body portion 4*a* of the bolt 4-2 engages the recess portion 4*c* of the bolt 4-1 which has already been set at the above mentioned position in the hole 3. According to the above mentioned process, the bolt 4-3 is inserted and engages the recess portion 4*c* of the bolt 4-2. Then the bolts 4-4, 4-5 and 4-6 are inserted and they are engaged in the holes 2 and 3. As a result, the heights of the holes 2 and 3 should be formed as shown in FIG. 2A so the assembled thickness of the bolts can be inserted.

Figure 3:
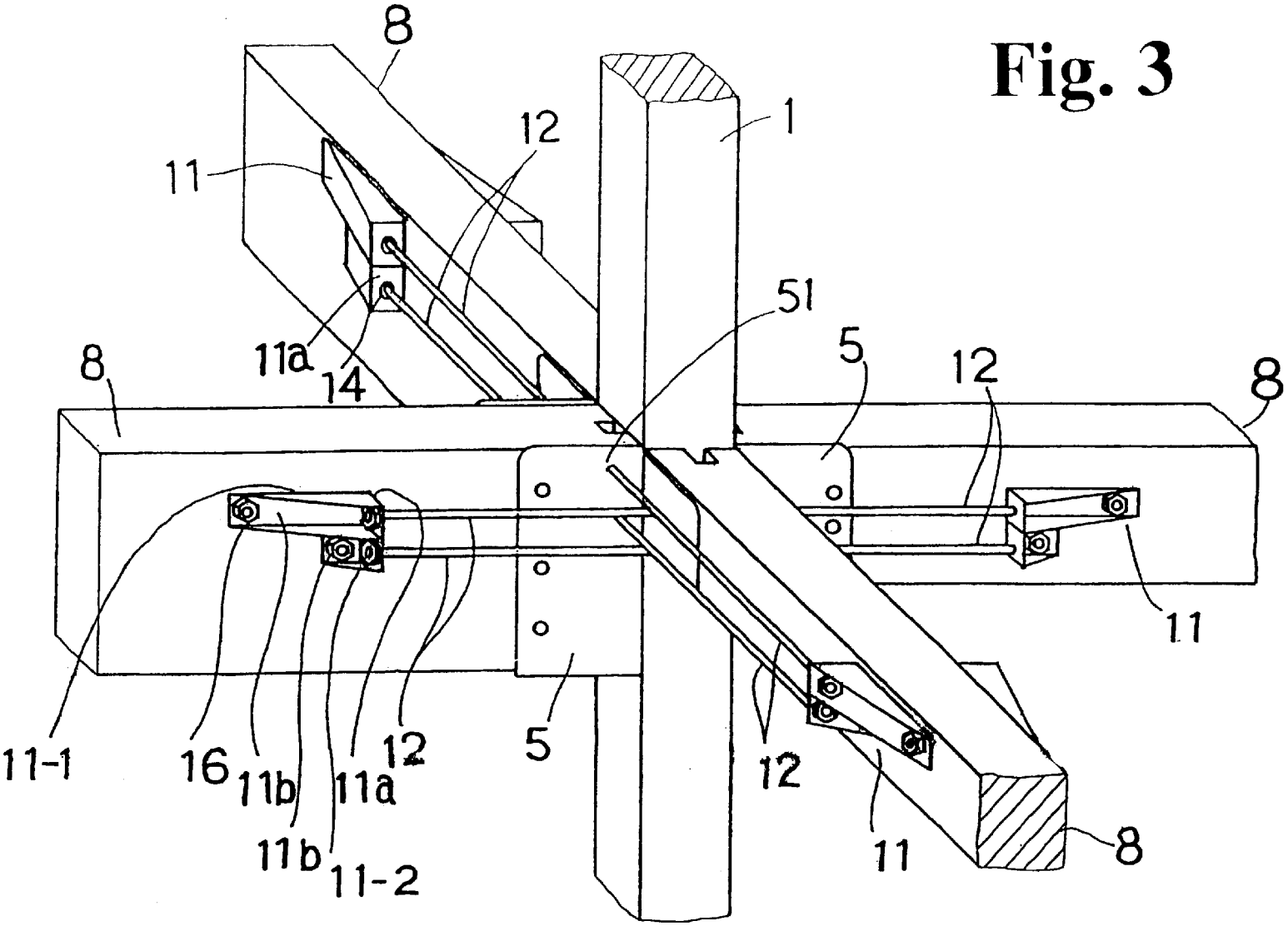
FIG. 3 is a perspective view the metal fittings and bolts assembled to a column and cross beams in accordance with the first embodiment of the present invention.

FIG. 3 is a perspective view showing an assembled condition for the metal fittings, the attachment bolts, the column and the cross beams. FIG. 3 also shows reinforcement brackets 11 to reinforce the cross beams. The reinforcement bracket 11 comprises a vertical surface 11*a* having an insert hole 14 to insert the reinforcement bolt 12 and an attachment surface 11*b* having an insert hole 16 to insert a fixing bolt which attaches the reinforcement bracket 11 to the cross beam 8. The fixing bolt 15 as shown in FIG. 4 comprises a main body portion having a rectangular cross section and both edge portions having bolt portions.

A side surface of the cross beam attached the reinforcement bracket 11 has an insert hole 17 as shown in FIG. 1 which has a rectangular cross section and into which the bolt 15 is inserted. One side surface of the cross beam 8 has two reinforcement brackets 11-1 and 11-2. Since each of the attachment surfaces 11*b* of the two brackets 11-1 and 11-2 has a different length and the position of the insert holes 16 corresponding to the cross beam 8 is different from the other, the load input from the brackets 11-1 and 11-2 to the cross beam 8 is not concentrated in only one position.

It will be described hereinafter how to attach a reinforcement member to the timber construction.

Initially, the bolt 15 and the reinforcement bracket 11 are attached to the opposite side surfaces of the cross beams 8. Then, the reinforcement bolt 12 is inserted into the through hole 14 of the vertical surface 11*a* of the reinforcement bracket 11 and then the bolt 12 is screwed tight by the nut on the bracket 11. Accordingly, since two cross beams 8 are disposed at opposite sides of each other there is a force toward cross beam 8 on the other side. Thus, the connecting strength of the two cross beams is remarkably improved. Further, the bolt 12 passes in a through hole 51 disposed in the metal fitting 5 and in the cross beam 8.

FIGS. 5A and 5B show second and third embodiments for the attachment bolt 4. The attachment bolt 4 has a main body portion having a triangular cross section in FIG. 5A. In this case, the bolt 4 has a relatively large area at the bottom portion to transfer the load to the column. Each of the above attachment bolts 4 of the first and second embodiments, has an integral main body portion and a bolt portion which are made of steel and are formed by a shaving process. However, it is preferred that the attachment bolt 4 comprise a main body portion made of steel and having an insert hole at both edge portions to insert one edge portion of the bolt portion into the insert hole. The bolt portions have connecting portions to the insert holes respectively at both edge portions of the main body portion. Further, as shown in FIG. 5B, the bolt 4 has a main body portion having a cross-shaped cross sectional view which is made by a combination of flat plates and this comprises a third embodiment of the attachment bolt 4. In this case, the bolt portions disposed at both edge portions of the main body portion are fixed by welding.

When the above bolts 4 as shown in FIG. 5A and FIG. 5B are used, the assembling steps of the bolts 4 to the column are the same as the assembling steps in the first embodiment.

How to assemble the cross beams 8 to the surfaces of the column 1 has now been described. The described assembly steps can also be adapted to connecting a corner column and the respective cross beams in a timber construction.

Figure 6:
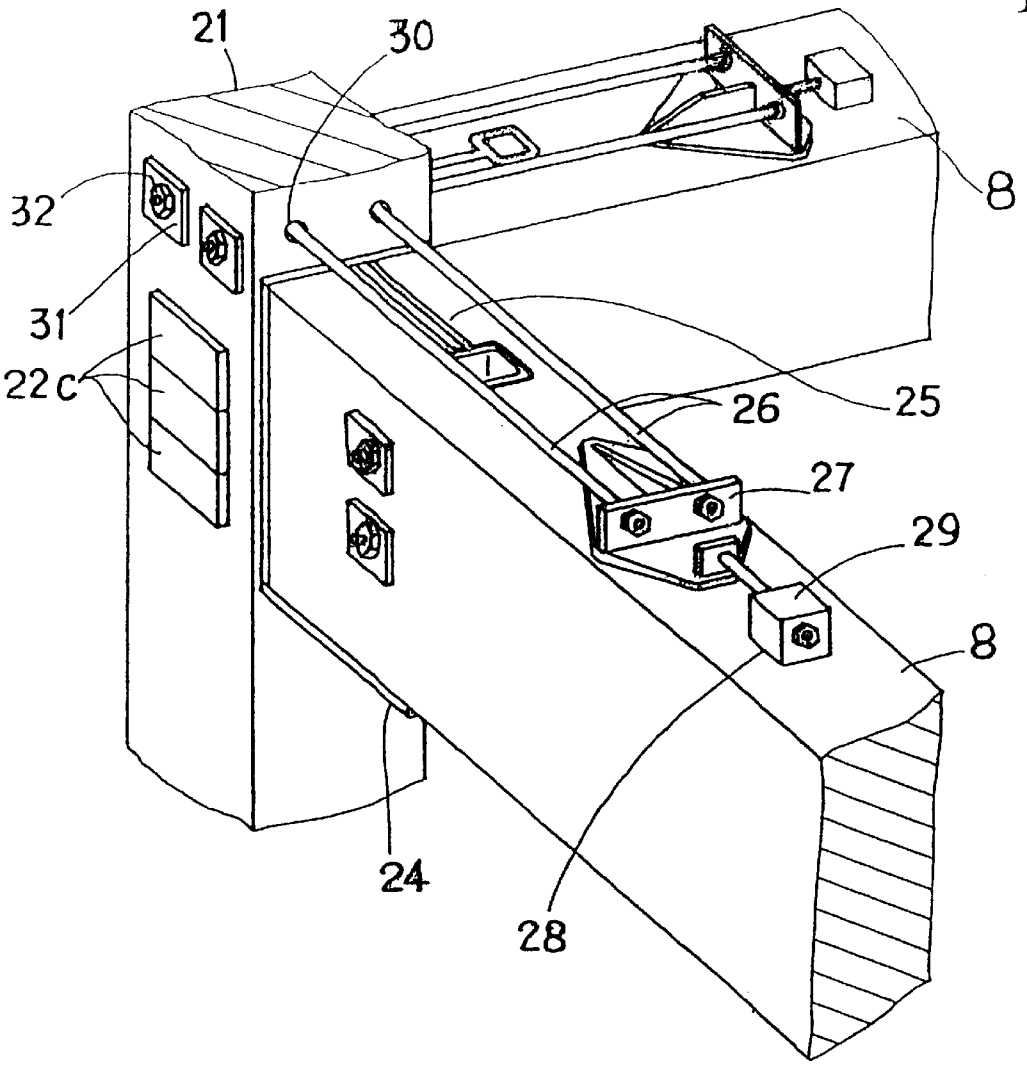
FIG. 6 is a perspective view showing metal fittings and attachment bolts assembled to a column and cross beams in accordance with a still further embodiment of the present invention.
Figure 7:
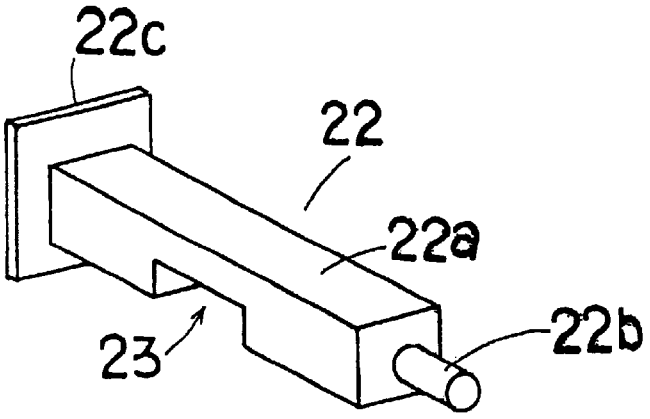
FIG. 7 is a perspective view of an attachment bolt in accordance with the still further embodiment of the present invention.

FIG. 6 is a perspective view showing a connecting structure between a corner column and horizontal cross beams. A corner column 21 has two through holes (not shown) into which are inserted attachment bolts 22. Each of the holes is disposed in the column 21 at right-angles to each other respectively. The attachment bolt 22 comprises a main body portion 22*a* having a rectangular shaped cross section, a bolt portion 22*b* disposed at one edge portion of the main body portion 22*a* and a stopper portion 22*c* disposed at the other edge portion of the main body portion 22*a*. The width of the stopper portion 22*c* is larger than the width of the through hole so as to have a stopper function.

Figure 9:
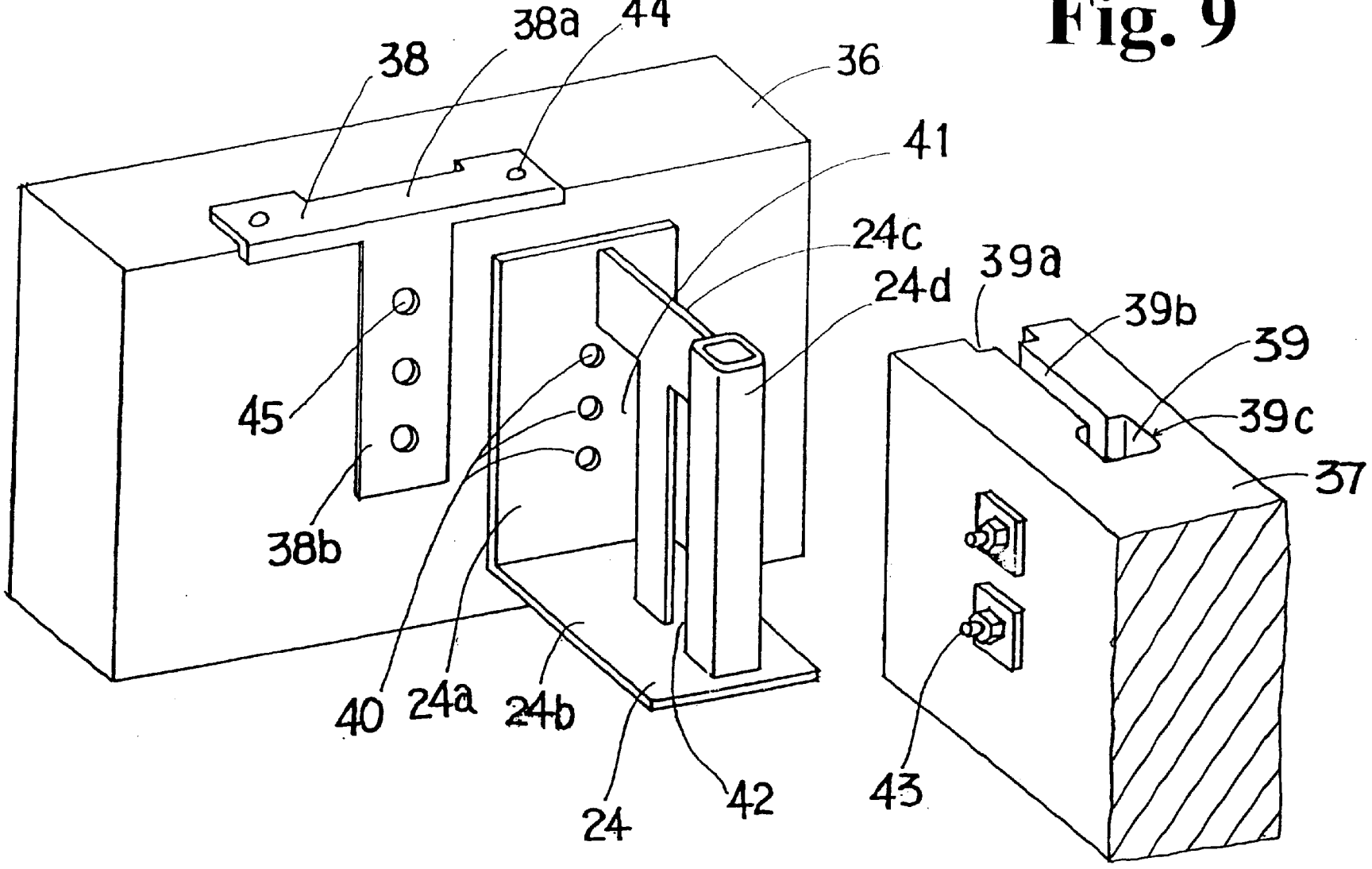
FIG. 9 is a perspective view of a connecting structure for connecting a large cross beam and a small cross beam in accordance with another embodiment of the present invention.

The main body portion 22*a* has a recess portion 23 having a predetermined width and depth and being disposed at the center and lower position of the main body portion 22*a*. The bottom of the recess portion 23 is formed so as to be parallel with the lower surface of the main body portion 22*a* and is in surface contact with an upper surface of the other bolt 22 (not shown) which has been inserted into the corner column 21 through the other through hole that is disposed at right angles. The other bolt is disposed beyond the above mentioned bolt 22 and has the same structure as the above mentioned bolt 22. A metal fitting 24 attached to the bolt portion 22*b* of the attachment bolt 22 is different from the metal fitting 5 in the first embodiment. In detail, the metal fitting 24 is inserted into a slit which is formed in the cross beam 8 and the detailed structure of the metal fitting 24 is shown in FIG. 9.

It will be described hereinafter how to connect the corner column 21 and the cross beam 8. First, each of the attachment bolts 22 are inserted in the through holes of the corner column 21 and they are positioned in predetermined positions in the corner column 21. Since the bolt inserting process is the same as the first embodiment of the present invention, the explanation is omitted for brevity of description. The metal fitting 24 is fixed to the column 21 by the bolts 22 and each metal fitting 24 is inserted into each slit portion 25 of the cross beams 8 and is attached by bolts from both sides of the cross beams 8.

In this case, the attachment method of the reinforcement is also different from the attachment method in the first embodiment. In detail, the reinforcement member connects between the cross beam 8 and the corner column 21 and is disposed on a vertical surface of the cross beam 8. One end of a reinforcement bolt 26 is fixed to a reinforcement bracket 27 fixed to the cross beam 8 by a nut. The reinforcement bracket 27 is directly fixed to the cross beam 8 and is connected to a square column 29 inserted in a through hole 28 disposed in the cross beam 8. The other end of the bolt 26 is inserted into a through hole 30 disposed in the corner column 8 and fixed to the corner column 21 by a washer 31 and a nut 32. The reinforcement member which is the same structure as the above mentioned structure, is attached to the lower surface of the cross beam 8. The other edge portion of the square column 29 projects downwardly from the cross beam 8 and is connected to the reinforcement bracket disposed on the lower surface of the cross beam 8.

Figure 8:
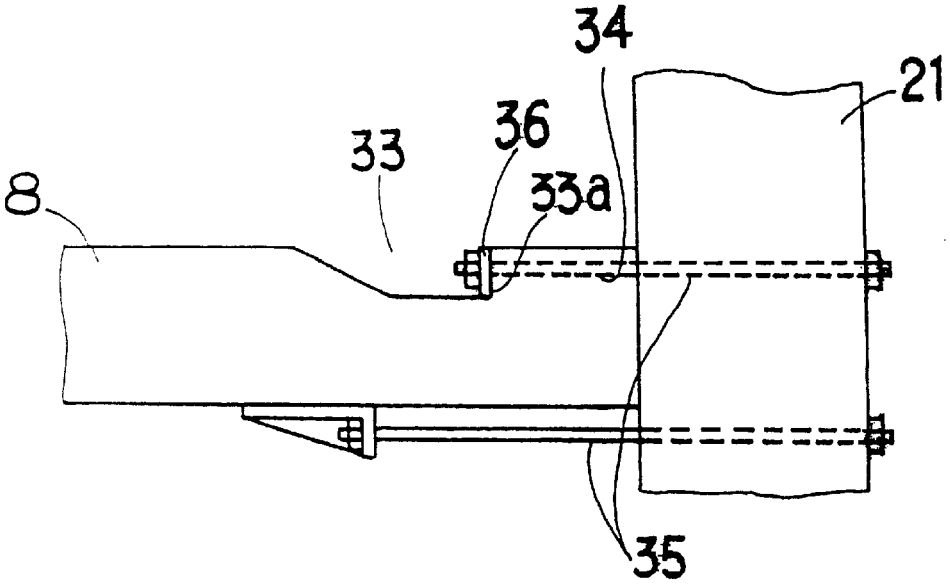
FIG. 8 is a side view of a reinforcement member in accordance with another embodiment of the present invention.

FIG. 8 shows another embodiment for the reinforcement member having no reinforcement bracket on one side. A predetermined position disposed on the upper surface of the cross beam 8 has a recess portion 33 having a vertical surface 33*a*. A plurality of through holes 34 extending in the longitudinal direction of the cross beam 8 are disposed on the vertical surface 33*a* and reinforcement bolts 35 are inserted into the through holes 34. The attachment of the bolts 35 is carried out by nuts and a metal flat plate 36 which prevents the cross beam 8 from a collapse caused by the tightening of the cross beam 8 by the bolts 35 and nuts. It is preferred that the above mentioned embodiment of the reinforcement member is adapted so as to avoid interference between the reinforcement bracket as explained in the first embodiment and the other structures and is required when a good exterior appearance is desired.

FIG. 9 also shows a metal fitting 24 adapted to have a portion connected to both cross beams 36 and 37. A receiving metal fitting 24 and a connecting metal fitting 38 are used to connect the large cross beam 36 to the small cross beam 37. The receiving metal fitting 24 comprises a vertical member 24*a*, a supporting member 24*b*, a member 24*c* and a square member 24*d* to expand the contact area between the receiving metal fitting 24 and the small cross beam 37 for adding connecting strength between the fitting 24 and the beam 37. Further, the members 24*a*, 24*b*, 24*c* and 24*d* are connected to each other by welding.

The small cross beam 37 has a slit portion 39 which comprises a space portion 39*a* to avoid an interference with a bolt for fixing which will be described in detail hereinafter, a space 39*b* to insert the member 24*c* of the receiving metal fitting 24 and a space 39*c* to insert the square member 24*d* of the metal fitting 24. The vertical member 24*a* has a plurality of holes 40 to insert bolts for fixing.

Further, the member 24*c* is a T-shaped form. A first space 41 is disposed between the member 24*c* and the vertical member 24*a*, and a second space 42 is disposed between the member 24*c* and the square member 24*d*. The first space is provided to prevent interference with the above mentioned fixing bolt and the second space is provided for bolt 43 and to fix the metal fitting 24 to the cross beam 37, after the fitting 24 is inserted into the slit portion 39 of the cross beam 37.

A bolt 43 has a main body portion having a rectangular shape and a bolt portion disposed at both edge portions of the main body portion. The width of the main body portion of the bolt 43 is substantially the same as the second space. Since the bolt 43 is disposed so as to contact the member 24*c* and the square member 24*d* disposed at the upper end portion of the second space 42, movement of the cross beam in all directions can be restricted.

Further, since the thickness of the square member 24*d* is larger than the thickness of member 24*c*, it is easy to position the cross beam 37 and the bending and torsional loads that are input from the cross beam 37 can be effectively transferred to the cross beam 36. The connecting metal fitting 38 has a horizontal surface 38*a* fixed to the upper surface of the cross beam 36 by nails 44 and a vertical surface 38*b* contacting the side surface of the cross beam 36. The vertical surface 38*b* has insert holes 45 to insert the bolt which connect the cross beam 36 to the fitting 24.

The cross beam 36 has at least one through hole to insert the bolt. Then the fitting 24 and the cross beam 36 are attached by bolts by way of the connecting metal fitting 38. In case of this embodiment, the bolts connecting the fitting 24 to the cross beam are regular round bolts.

In this embodiment, the connecting metal fitting 38 is used to diffuse the input load to a large space. Further, the fitting 24 shown in FIG. 9 is the same as the fitting which is shown in FIG. 6 so as to use the same product for several kinds of structures.

In the above embodiments, since the column extends up and down and the bolts having the recessed portions are alternately inserted into the column at right angles to each other and are engaged with the other bolt by the recess portion, the strength of the column against a moment force in an axis of the column is extremely improved when compared with the conventional structures.

Figure 10A:
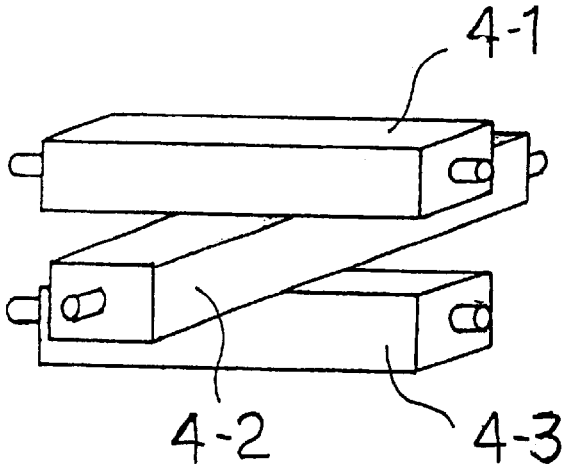
FIGS. 10A, 10B and 10C are perspective views showing the assembly of attachment bolts forming a connecting structure in accordance with various embodiments of the present invention.

However, if the timber construction is not required to have such strength against such a large moment, the recess portion can be canceled from the bolt as shown FIG. 10A. This bolt has the main body portion having only a rectangular cross section. Therefore, when each of the bolts 4-1, 4-2 and 4-3 is inserted into the through holes, the lower surface of the newly inserted bolt is in surface contact with the upper surface of the previously inserted bolt which has been inserted at right angles.

In this case, an inexpensive bolt can be provided as compared to the bolt described in the first embodiment. Further, the strength of this bolt is larger than the other bolt structure, since this bolt does not have a recessed portion.

Further, in the above embodiments, the recess portion of the bolt was described as being disposed on the lower surface of the bolt. However, the recess portion can be formed on the upper surface of the bolt and can be assembled with the other bolt also having the recess portion on the upper surface based on the requirement of the specific timber construction and the convenience of assembly of the bolts.

When the bolt has the recess portion disposed on only the upper surface of the bolt, the bolt positioned at the lowest position in the holes 2 is inserted first and then alternately the other bolts are inserted into the holes 2 and 3 on top of each other.

Further, in the above mentioned embodiments, it is preferred that the depth of the recess portion is substantially half of the thickness of the bolt.

However, when it is not necessary to contact each bolt with the other bolt with no clearance at the joint, it is also preferred that the depth of the recess portion is equal to, less than or larger than a half of the thickness of the bolt based on considering the bolt processing expenses and the degree of precision for bolt processing.

Figure 10B:
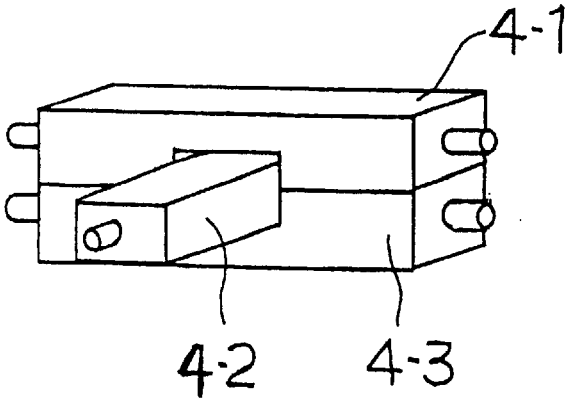
Figure 10C:
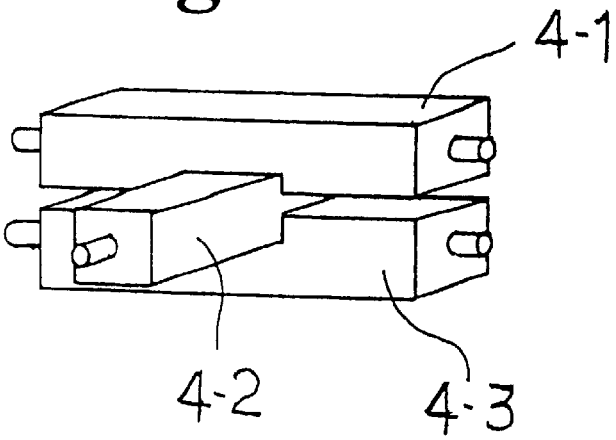

In other words, when the combined depth of the recess portions of the bolts 4-1 and 4-3 is set to be larger than the thickness of the bolt 4-2 as shown in FIG. 10B, it is enough that the lower surface of the bolt 4-1 is in surface contact with the upper surface of the lower bolt 4-3 which is inserted from the same direction in the same through hole. On the other hand, when the depth of the combined recess portions is set to be smaller than the thickness of the bolt as shown in FIG. 10C, it is enough that the upper surface of the recess portion is in surface contact with the upper surface of the lower bolt 4-2 which is inserted at right angles to the above bolt inserted through the other through hole. Further, the recess portion disposed in the bolt can be disposed in the upper and lower surfaces of the bolt at the same time.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. A connection structure for connecting a column and cross beam comprising:

a column extending in a substantially vertical direction;

a first cross beam extending in a substantially horizontal direction for connecting with a first vertical surface of said column;

a second cross beam extending in a substantially horizontal direction for connecting with a second vertical surface of said column disposed at right angles to said first vertical surface;

a first through hole formed in said column from said first vertical surface;

a second through hole formed in said column from said second vertical surface and having a common space with said first through hole in said column;

a first attachment bolt inserted into said first through hole of said column; said first attachment bolt having a first main body portion and a first bolt portion, said first main body portion being disposed in said column and said first bolt portion extending in the substantially horizontal direction from said first main body portion to the outside of said column;

a second attachment bolt inserted into said second through hole of said column; said second attachment bolt having a second main body portion and a second bolt portion, said second main body portion being disposed in said column and said second bolt portion extending in the substantially horizontal direction from said second main body portion to the outside of said column, and an upper surface of said second main body being in surface contact with a lower surface of said first attachment bolt when said first and second attachment bolts are inserted into said first and second through holes respectively and positioned in predetermined positions in said common space;

a first fitting member having a first bolt portion insert hole and a first supporting section, said bolt portion insert hole receiving said first bolt portion of said first attachment bolt therein and said first supporting section supporting said first cross beam; and a second fitting member having a second bolt portion insert hole and a second supporting section, said second bolt portion insert hole receiving said second bolt portion of said second attachment bolt therein and said second supporting section supporting said second cross beam.

2. The connection structure as defined in claim 1, wherein at least one of said lower surface of said first attachment bolt and said upper surface of said second attachment bolt has a recess portion and said recess portion is in surface contact with the other surface of said first or second attachment bolt.

3. The connection structure as defined in claim 2 wherein said recess portion has right and left side surfaces and a bottom surface, each of said first and second main body portions has right and left side surfaces, said right and left side surfaces of said recess portion being in surface contact with said right and left side surfaces of the other main body portion and said bottom surface of said recess portion being in surface contact with at least one of said upper and lower surfaces of the other main body portion.

4. The connection structure as defined in claim 3, wherein said first attachment bolt has said first recess portion having said right and left side surfaces and a bottom surface and when said first and second attachment bolts are assembled, said right and left side surfaces and said bottom surface of said first attachment bolt are in surface contact with said right and left side surfaces of said second main body portion and said upper surface of said second attachment bolt respectively.

5. The connection structure as defined in claim 3, wherein said second attachment bolt has said second recess portion having said right and left side surfaces and said bottom surface and when said first and second attachment bolts are assembled, said right and left side surfaces and said bottom surface of said second attachment bolt are in a surface contact with said right and left side surfaces of said first main body portion and said upper surface of said first attachment bolt respectively.

6. The connection structure as defined in claim 1, wherein at least one of said lower surface of said first attachment bolt and said upper surface of said second attachment bolt has a recess portion and said recess portion engages with the other surface of said first or second attachment bolt.

7. The connection structure as defined in claim 6, wherein a depth of said first recess portion is substantially the same as a depth of said second through hole and an amount of the offset of said first through hole from said second through hole is substantially equal to a difference between a depth of said first recess portion and a thickness of said first main body portion of said first attachment bolt.

8. The connection structure as defined in claim 1, wherein at least one of said first and second attachment bolts comprises a plurality of attachment bolts.

9. The connection structure as defined in claim 1, wherein said first through hole is offset in a vertical direction from said second through hole.

10. A connection structure for connecting a column and cross beam comprising:

a column extending in a substantially vertical direction;

a first cross beam extending in a substantially horizontal direction for connecting with a first vertical surface of said column;

a second cross beam extending in a substantially horizontal direction for connecting with a second vertical surface of said column disposed at right angles to said first vertical surface;

a first through hole formed in said column from said first vertical surface;

a second through hole formed in said column from said second vertical surface and having a common space with said first through hole in said column;

a first attachment bolt inserted into said first through hole of said column; said first attachment bolt having a first main body portion, a first recess portion, left and right side surfaces and a first bolt portion; said first main body portion being disposed in said column, said first recess portion formed on at least one of an upper surface and a lower surface of said first main body portion, said right and left side surfaces extending in the substantially vertical direction and said first bolt portion extending in the substantially horizontal direction from said first main body portion to the outside of said column;

a second attachment bolt inserted into said second through hole of said column; said second attachment bolt having a second main body portion, a second recess portion, right and left side surfaces and a second bolt portion; said second main body being disposed in said column, said second recess portion formed in at least the same surface as said surface of the first attachment bolt having said first recess portion, said right and left side surfaces extending in the substantially vertical direction, said second bolt portion extending in the substantially horizontal direction from said second main body portion to the outside of said column, and said second recess portion engaging with said right and left side surfaces of said first attachment bolt against said surface having said first recess portion when said first and second attachment bolts are inserted into said first and second through holes respectively and being positioned at their predetermined positions in said common space;

a first fitting member having a first bolt portion insert hole and a first supporting section, said first bolt portion insert hole receiving said first bolt portion of said first attachment bolt and said first supporting section supporting said first cross beam; and a second fitting member having a second bolt portion insert hole and a second supporting section, said second bolt portion insert hole receiving said second bolt portion of said second attachment bolt and said second supporting section supporting said second cross beam.

11. A connection method for connecting a column and first and second cross beams, the column extending in a substantially vertical direction, the first cross beam extending in a substantially horizontal direction to connect with a first vertical surface of the column, the second cross beam extending in the substantially horizontal direction to connect with a second vertical surface of the column disposed at right angles to the first vertical surface, comprising the steps of:

forming a first through hole extending from the first vertical surface to an interior of the column;

forming a second through hole extending from the second vertical surface to the interior of the column and having a common space with the first through hole in the column;

inserting a first attachment bolt into the first through hole and positioning the first attachment bolt at a predetermined position in the column; the first attachment bolt comprising a first main body portion and a first bolt portion, the first main body portion having flat portions on upper and lower surfaces thereof and the first bolt portion extending in the substantially horizontal direction from the first main body portion;

inserting a second attachment bolt into the second through hole; the second attachment bolt comprising a second main body portion and a second bolt portion, the second main body portion having flat portions at upper and lower surfaces thereof and a second bolt portion extending in the substantially horizontal direction from the second main body portion;

positioning and contacting the upper surface of the second attachment bolt with the lower surface of the first attachment bolt at a predetermined position in the common space; and connecting the first and second bolt portions of the first and second attachment bolts to first and second fitting members respectively and supporting the first and second cross beams with first and second supporting sections of the first and second fitting members respectively.

12. The connection method as defined in claim 1, wherein said step of forming the first hole is done so that at least one of the upper and lower end portions of the first through hole is formed to have an offset against an end portion of the second through hole that is the same side end portion to the at least one of the upper and lower end portions of the first through hole having the offset.

13. A connection method for connecting a column and first and second cross beams, the column extending in a substantially vertical direction, the first cross beam extending in a substantially horizontal direction to connect with a first vertical surface of the column, the second cross beam extending in the substantially horizontal direction to connect with a second vertical surface of the column disposed at right angles to the first vertical surface, said method comprising the steps of:

forming a first through hole extending from the first vertical surface to the interior of the column;

forming a second through hole extending from the second vertical surface to the interior of the column and having a common space with the first through hole in the column;

inserting a first attachment bolt into the first through hole and positioning the first attachment bolt at a predetermined position in the column; the first attachment bolt comprising a first main body portion, a first recess portion and a first bolt portion; the first main body portion having flat portions on upper and lower surfaces of the first main body portion respectively, the first recess portion formed in at least one of the upper and lower surfaces and the first bolt portion extending in the substantial horizontally direction from the first main body portion;

inserting a second attachment bolt into the second through hole, the second attachment bolt comprising a second main body portion, a second recess portion and a second bolt portion; the second main body portion having flat portions at upper and lower surfaces of the second main portion respectively, the second recess portion formed in at least one of the upper and lower surfaces which is the same surface to the first recess portion of the first attachment bolt and the second bolt portion extending in the substantially horizontal direction from the second main body portion;

positioning and engaging the second main body portion of the attachment bolt with the recess portion of the first attachment bolt at a predetermined position in the common space; and connecting the first and second bolt portions of the first and second attachment bolts to first and second fitting members respectively and supporting the first and second cross beams with first and second supporting sections of the first and second fitting members respectively.

14. The connection method as defined in claim 13, wherein said step of forming the first hole is done so that at least one of the upper and lower end portions of the first through hole is formed to have an offset against an end portion of the second through hole that is at the same side end portion as the at least one of the upper and lower end portions of the first through hole having the offset.

15. The connection method as defined in claim 14, further comprising the steps of providing the depth of the first recess portion and the thickness of the main body portion of the first attachment bolt to be substantially the same as the depth of the second recess portion and the thickness of the main body portion of the second attachment bolt, and forming the amount of offset to be equal to or larger than a value that is the difference between the depth of the recess portion and the thickness of the main body portion of the attachment bolt.

16. The connection method as defined by claim 13, wherein the first attachment bolt comprises a plurality of bolts, the second attachment bolt comprises a plurality of bolts, and said method comprises inserting each of the first attachment bolts and each of the second attachment bolts into the first and second through holes respectively and alternately, positioning and engaging the second main body portion of the second attachment bolt with the recess portion of the first attachment bolt at a predetermined position in the common space.

* * * * *